US006758939B2

(12) United States Patent
Marquardt et al.

(10) Patent No.: US 6,758,939 B2
(45) Date of Patent: Jul. 6, 2004

(54) LAMINATED WEAR RING

(75) Inventors: David Marquardt, Phoenix, AZ (US); Wayne Lougher, Phoenix, AZ (US); Stephen C. Schultz, Gilbert, AZ (US)

(73) Assignee: Speedfam-Ipec Corporation, Chandler, AZ (US)

( * ) Notice: Subject to any disclaimer, the term of this patent is extended or adjusted under 35 U.S.C. 154(b) by 306 days.

(21) Appl. No.: 09/943,699

(22) Filed: Aug. 31, 2001

(65) Prior Publication Data

US 2003/0041967 A1 Mar. 6, 2003

(51) Int. Cl.[7] ..... B24B 1/00
(52) U.S. Cl. ..... 156/345.14; 451/51
(58) Field of Search ..... 156/345.12, 345.14, 156/345.13; 451/51

(56) References Cited

U.S. PATENT DOCUMENTS 5,695,392 A * 12/1997 Kim ..... 451/288
5,759,918 A * 6/1998 Hoshizaki et al. ..... 438/692
6,251,215 B1 6/2001 Zuniga et al.
6,520,859 B2 * 2/2003 Beitzel et al. ..... 464/132
6,602,116 B1 * 8/2003 Prince ..... 451/51

FOREIGN PATENT DOCUMENTS

GB 2336121 A * 10/1999 ..... B24B/37/04
JP 0776730 * 4/1997 ..... B24B/37/04

OTHER PUBLICATIONS

DSM Engineering Plastics Products. "Advanced Engineering Plastics for the Semiconductor Industry". 1996.*

* cited by examiner

*Primary Examiner*—P. Hassanzadeh
*Assistant Examiner*—Sylvia R. MacArthur
(74) *Attorney, Agent, or Firm*—Ingrassia Fisher & Lorenz, P.C.

(57) ABSTRACT

A laminated wear ring for a chemical mechanical planarization (CMP) apparatus provides improved control of the removal rate of material from the edge of a wafer during a polishing/planarization operation. The laminated wear ring includes a high stiffness stainless steel base and a plastic laminate. The high stiffness stainless steel base avoids flexing of the wear ring during polishing and thus provides control of the flexing of a polish pad against which the wafer surface is pressed. The plastic laminate protects the stainless steel base from attack by the polishing slurry and provides a buffer that protects the stainless steel base from mechanically damaging the wafer and vice versa.

18 Claims, 3 Drawing Sheets

LAMINATED WEAR RING

FIELD OF THE INVENTION

This invention relates generally to an apparatus for polishing or planarizing a work piece, and more particularly to a wear ring for a polishing or planarizing apparatus that improves the uniformity of the polishing or planarizing operation.

BACKGROUND OF THE INVENTION

The manufacture of many types of work pieces requires the substantial planarization of at least one surface of the work piece. Examples of such work pieces that require a planar surface include semiconductor wafers, optical blanks, memory disks, and the like. One commonly used technique for planarizing the surface of a work piece is the chemical mechanical planarization (CMP) process. In the CMP process a work piece, held by a work piece carrier head, is pressed against a moving polishing pad in the presence of a polishing slurry. The mechanical abrasion of the surface combined with the chemical interaction of the slurry with the material on the work piece surface ideally produces a planar surface.

The construction of the carrier head and the relative motion between the polishing pad and the carrier head have been extensively engineered in an attempt to achieve a uniform rate of removal of material across the surface of the work piece and hence to achieve the desired planar surface. For example, the carrier head generally includes a flexible membrane that contacts the back or unpolished surface of the work piece and accommodates variations in that surface. One or more pressure chambers may be provided behind the membrane so that different pressures can be applied to various locations on the back surface of the work piece to cause uniform polishing across the front surface of the work piece. The carrier head also generally includes a wear ring (sometimes referred to as a "retaining ring" or "edge ring" but hereinafter referred to without limitation as a "wear ring") that surrounds the membrane and the work piece and that pre-stresses or pre-compresses the polishing pad to protect the leading edge of the work piece. The wear ring, which has an internal diameter (ID) only slightly larger than the diameter of the work piece, also serves to constrain the work piece, maintaining the work piece properly positioned under the carrier head. The polishing pad may move in a linear motion, a rotational motion, or an orbital motion, depending on the type of CMP apparatus. Additionally, the carrier head, and hence the work piece, may also be in rotational motion. The relative motion between the work piece and the polishing pad is designed to attempt to provide equal polishing to all areas of the polished surface. This relative motion, however, combined with the small but finite spacing between the outer edge of the work piece and the inner diameter of the wear ring also contributes to collisions between the work piece and the wear ring. These collisions can cause damage to the edge of the work piece and to the wear ring.

Despite all the efforts to achieve uniform polishing across a work piece surface, however, a uniform removal rate is not always obtained. Instead, in some instances a "fast edge" or high removal rate at the edge of the work piece is observed. This effect sacrifices potentially valuable work piece area around the edge of the work piece. In the case in which the work piece is a semiconductor wafer, that work piece area could be used to generate additional devices on the wafer.

Analytical modeling of the polishing operation has shown that controlled pre-compressing of the polishing pad with a pressurized wear ring can influence the material removal rate at the edge of the work piece. Analytical modeling has also shown that flexing of the wear ring near the edge of the work piece may cause inadequate or otherwise uncontrolled compression of the polishing pad and may lead to non-uniformity in polishing at the work piece edge. Erosion of the wear ring near the edge of the work piece may also cause a non uniform edge removal rate. Accordingly, a need exists for a wear ring that resists flexing and that can be used to achieve uniform polishing across the entire surface of a work piece.

DETAILED DESCRIPTION OF THE INVENTION

Figure 1:
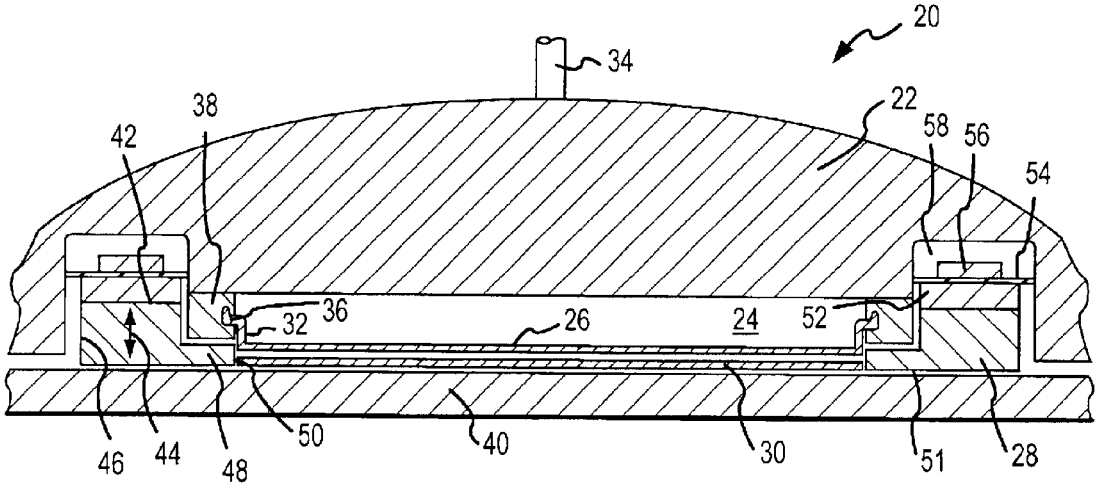
FIG. 1 illustrates, in cross section, a basic elements of a CMP carrier head.

For purposes of illustration only, the invention will be described in relationship to a chemical mechanical planarization (CMP) apparatus. Likewise, without loss of generality, but for ease of description and understanding, the following description of the invention will focus on applications to only one specific type of work piece, namely a semiconductor wafer. The invention, however, is not to be interpreted as being applicable only to semiconductor wafers or to CMP apparatus. Those of skill in the art instead will recognize that the invention can be applied to any generally disk shaped work pieces and is applicable to other types of polishing apparatus. FIG. 1 illustrates schematically, in cross section, basic elements of a carrier head 20 for one type of CMP apparatus with which a wear ring 28 in accordance with the invention may be used. The carrier head controllably presses a work piece, such as a semiconductor wafer 30, into contact with a polishing pad 40 to planarize the lower surface of the wafer. Carrier head 20 includes a rigid casing 22 having an annular cavity 24 on a lower surface. A flexible membrane 26 is stretched across the cavity and presses against the upper surface of wafer 30 and forces the wafer into contact with the polishing pad. A toroidal shaped wear ring 28 is attached to the rigid casing with a resilient attachment, to be more fully explained below. The wear ring surrounds cavity 24 and serves to precompress the polishing pad and to contain the lateral movement of wafer 30, thus maintaining the wafer in position on the underside of carrier head 20. The wear ring is positioned with its substantially planar lower surface in substantially the same plane as the lower surface of the wafer. Alternatively, the lower surface of the wear ring may be in a plane that is parallel to the plane of the lower surface of wafer 30 but that is slightly displaced in the vertical direction (say, by about 0.25 mm or less) from the wafer plane. The resilient attachment allows adjustment of the vertical height of the wear ring, for example, to modify process parameters, or to accommodate wafers of different thickness, and also allows correction for any mechanical tolerances in the rigid casing, the wear ring itself, or any other mechanical parts in the system. Rigid casing 22 is attached to a shaft 34 that allows the correct downward pressure to be applied to the carrier head and hence to wafer 30. Shaft 34 may also be used to impart a rotational motion to the carrier head to improve uniformity of the polishing action.

In a CMP process using a carrier head such as carrier head 20, wafer 30 is pressed into contact with polishing pad 40 in the presence of a polishing slurry. The pressure on the wafer is exerted by the carrier head through the pressure from shaft 34. To obtain a uniform pressure across the wafer and thus predetermined material removal rate distribution across the wafer (usually a uniform removal rate across the surface of the wafer), pressure is exerted against flexible membrane 26 by pressurized gases or fluids that are conveyed to cavity 24. The flexible membrane conforms to the shape of the upper surface of wafer 30 and presses the wafer against the polishing pad. Although only a single cavity 24 is illustrated, in some applications multiple cavities and multiple pressures are used to press the wafer against the polishing pad in an attempt to achieve the desired removal rate distribution. The polishing pad may be in rotational, orbital, or linear motion relative to wafer 30, depending on the particular type of CMP apparatus being utilized. Carrier head 20 may also be rotating on shaft 34.

Flexible membrane 26 includes a vertical edge portion 32 and an edge bead 36 that is clamped to the rigid casing at the edge of cavity 24 by an annular clamp 38. Because the flexible membrane extends to the edge of wafer 30, the upper surface 42 of wear ring 28 is configured to accommodate clamp 38. Wear ring 28 thus includes a thick portion 44 adjacent an exterior cylindrical surface 46 and a thin portion 48 adjacent an interior cylindrical surface 50. The total allowable thickness of thin portion 48 may be limited by the size of clamp 38 and by other physical parameters of the carrier head. Lower surface 51 of the wear ring is substantially planar. In one embodiment of the invention wear ring 28 is coupled to a wear ring mounting plate 52 that is clamped to a flexible wear ring diaphragm 54 by a clamp 56. The wear ring diaphragm provides a bottom seal to a wear ring cavity 58. Vertical positioning of the wear ring relative to the vertical positioning of the wafer to be polished is controlled by pressurized gases or other fluids that are conveyed to wear ring cavity 58. Increasing pressure in the cavity causes flexible wear ring diaphragm 54 to flex, moving wear ring 28 vertically downward. The wear ring can be attached to the wear ring mounting plate by bolts or other conventional fastening means. Of course, other mechanisms, such as springs or the like, may be employed for resilient attachment of the wear ring to the rigid casing of carrier head 20.

In prior art CMP apparatus the wear ring has been formed of a ceramic material or of plastic. These material were chosen because ceramic and plastic materials could be selected that were relatively inert to the chemicals used in the slurry. Unfortunately, use of these materials has caused problems associated with lack of uniformity in the polishing or planarizing process.

Ceramics that have been used for wear rings have tended to be hard, brittle materials. As such, they are susceptible to chipping. In addition, the hard material may cause damage to the work piece during collisions between the wear ring and the work piece that occur as the wafer moves against the polishing pad under the influence of the relative motion of the carrier head with respect to the polishing pad. Also, in the case, for example, of silicon semiconductor wafers, the silicon is also a hard material and can cause damage, chipping and/or erosion of the interior edge of a ceramic wear ring. Consequently, a soft lining material on the interior diameter of the wear ring was required. This lining material could wear after repeated polish operations, changing the ID of the wear ring and changing the wear ring profile at the critical comer of the inner diameter edge at which the wear ring contacts the work piece and the polishing pad.

Plastic wear rings do not have sufficient stiffness to contribute to the desired uniformity of material removal during wafer polishing. Shaped upper surface 42 of wear ring 28 creates a flexible, cantilevered section, i.e., thin portion 48, of the wear ring. During polishing, downward pressure is exerted on thick portion 44 of the wear ring by pressure on flexible wear ring diaphragm 54. This pressure could not be adequately transferred to the thin portion of a plastic wear ring because of the flexible nature of the plastic material, and consequently the thin portion has a tendency to bend. After repeated usage the thin portion tends to warp, buckle, or "potato chip," compromising the desired substantially planar lower surface of the wear ring and the critical profile of the wear ring at the inner diameter comer. The plastic wear ring thus becomes incapable of adequately and reliably precompressing the polishing pad.

Figure 2:
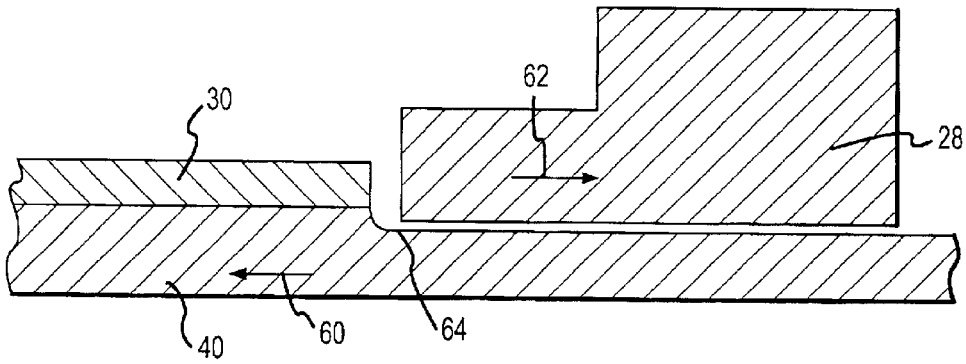
FIG. 2 illustrates, in cross section, the portion of a CMP apparatus at which the wear ring abuts the work piece and precompresses the polishing pad.

Problems associated with the use of ceramic or plastic wear rings can be better understood by reference to FIG. 2 which illustrates, in cross section, the area of the CMP apparatus at which the edge of the wafer abuts the inner diameter of the wear ring. As polishing pad 40 moves to the left in the figure as indicated by arrow 60 (or the wear ring moves to the right as indicated in the figure by arrow 62), wear ring 28 compresses the polishing pad. The compression of the polishing pad occurs ahead of the leading edge of wafer 30. The inner diameter pad recovery point, indicated by the number 64, is located at the trailing edge of the wear ring. The inner diameter pad recovery point is that location at which polishing pad 40 begins to decompress. As the thin portion of a plastic wear ring flexes or warps, the pad recovery point moves to a greater radial location, i.e., further from the center of the wafer and/or the wear ring. For a stiff ceramic wear ring, the pad recovery point would be near the ID of the wear ring. The use of a compliant liner to prevent damage to the wear ring or to the wafer, however, moves the pad recovery point from the inner diameter of the wear ring to the inner edge of the liner, a location closer to the center of the wafer. As the compliant liner material wears, the pad recovery point shifts, sometimes in an unpredictable manner. Failure to adequately control the pad recovery point leads to nonuniformity of material removal rate from the surface of the wafer and especially from the edge region of the wafer. Maintaining the desired profile of the ID comer of the wear ring adjacent the pad recovery point is thus important to controlling the uniformity of material removal rate about the edge of the wafer.

Figure 3:
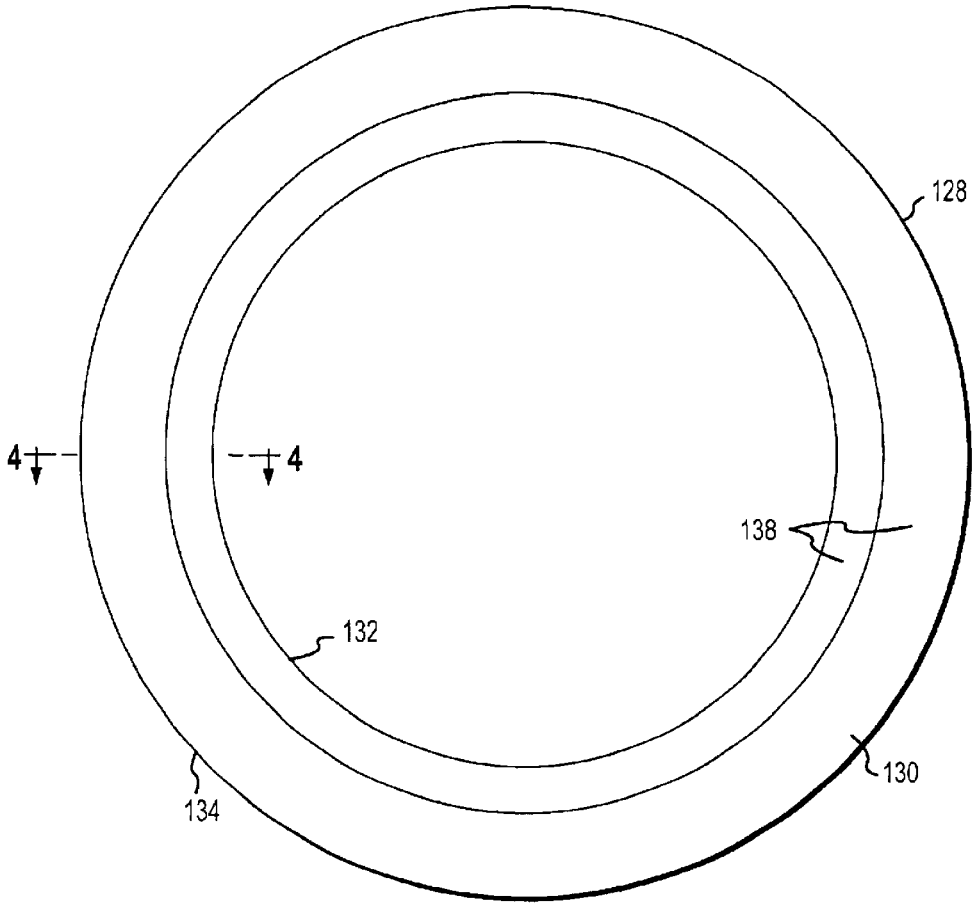
FIGS. 3 and 4 illustrate, in top plan view and side view, respectively, a wear ring in accordance with one embodiment of the invention.
Figure 4:
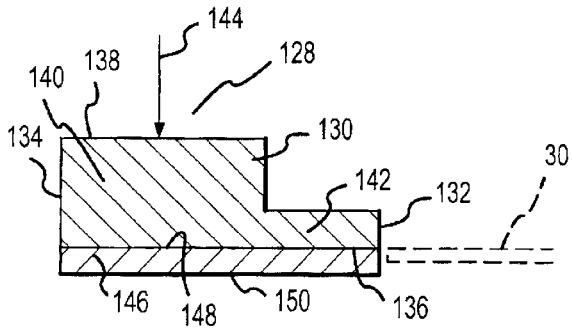

FIGS. 3 and 4 illustrate, in top plan and cross sectional views, respectively, a wear ring 128 in accordance with one embodiment of the invention. Wear ring 128 includes a toroidal shaped component 130 formed of a high stiffness material such as stainless steel having an inner cylindrical surface 132 and an outer cylindrical surface 134. The ID of inner cylindrical surface 132 is preferably slightly greater than the diameter of the work piece to be polished. For example, for the polishing of a 200 millimeter (mm) diameter silicon wafer, the ID of the wear ring is preferably about 201 mm. Lower surface 136 of component 130 is substantially planar. Upper surface 138 is configured to provide a thick portion 140 of component 130 adjacent the outer cylindrical surface and a relatively thinner portion 142 of component 130 adjacent the inner cylindrical surface. By "high stiffness material" is meant that the material from which component 130 is fabricated has sufficient stiffness to insure that downward forces applied to thick portion 140 as indicated schematically by arrow 144 are conveyed to thinner portion 142 without significantly warping or otherwise deforming the thinner portion.

In accordance with this embodiment of the invention, wear ring 128 also includes a plastic laminate 146 which is attached to lower surface 136 of component 130. The plastic laminate is toroidal shaped and has an upper surface 148 and a lower surface 150 each of which are substantially planar. The planar upper surface of plastic laminate 146 is attached to the planar lower surface 136 by an adhesive such as a pressure sensitive adhesive or by other conventional joining mechanism. The plastic laminate, which can be formed of DELRIN, ERTALYTE TX, polyethyleneterephthlate (PET), polyetheretherketone (PEEK) or other plastic material resistant to the chemicals normally used in a CMP slurry, protects the stainless steel from chemical attack. Preferably a plastic material is selected that provides the desired chemical resistance and is also substantially resistant to abrasive wear. In a preferred embodiment, the plastic laminate is formed of Ertalyte TX, a material available from DSM Plastic Products of Reading, Pa. ERTALYTE TX is believed to be a two-phase material made from PET and polytetraflouroethylene (PTFE) plastics. This material is preferred because it has a better wear resistance in the presence of polishing slurries than do other plastic materials. A suitable plastic material may be characterized by a wear resistance factor, known as K-factor. A suitable K-factor, as measured by a PTM 55010 test method, may be less than about $100\times10^{-10}$ $in^3$min./lb.-ft.-hr., and preferably less than about $50\times10^{-10}$ $in^3$-min./lb.-ft.-hr. A material such as ERTALYTE TX made from PET and PTFE is also preferred because of its low coefficient of friction. A suitable coefficient of friction as measured using a DSM EPP 55007 test method may be less than 0.3, and preferably no more than 0.2.

Preferred adhesives are rubberized epoxies such as Cemedine Super X 8008 Adhesive available from Cemedine Corp. of Oak Creek, Wis. because of the long term flexibility of the material. Other adhesives that may be used include, for example, acrylic adhesives such as acrylic adhesives 9469 and 4920 available from 3M Bonding System Division, 3M Corp. of St. Paul, Minn., and Cyanoacrylate adhesives such as Loctite Product 401 Cyanoacrylate Adhesive, available from Loctite Co., 1001 Trout Brook Crossing, Rocky Hill, Conn. 06067. Adhesion of the upper surface 148 of plastic laminate 146 to the lower surface 136 of component 130 can be enhanced by roughening both surfaces. For example, sandpaper or other suitable abrasive means may be used to roughen or scratch the surfaces. Alternatively concentric grooves or other geometric shapes or patterns may be formed in either surfaces 148 or 136 to increase the surface area contacted by the adhesive and thereby improve adhesion.

Preferably the plastic laminate has a thickness greater than the thickness of wafers that are to be processed in the polishing apparatus. If the thickness is so chosen, contact between the wafer and the wear ring will occur in the laminate itself, and not at the intersection where the laminate is attached to the high stiffness component. Repeated contact of the wafer with the intersection may lead to undesirable partial delamination of the plastic from component 130. In a preferred embodiment, for polishing a semiconductor wafer having a thickness of about 0.75 mm (approximately 0.030 inches), the plastic laminate has a thickness of about 1.0 mm–1.5 mm (approximately 0.040 inches–0.060 inches). The maximum thickness of the thin portion of the wear ring is determined by the need to accommodate the annular clamp used to hold the flexible membrane that presses against the back of the wafer during a polishing operation. The maximum thickness of the plastic laminate, in turn, is determined by the need to keep thinner portion 142 of component 130 of sufficient thickness to insure that the thinner portion does not warp or buckle. The use of a high stiffness material for the fabrication of the wear ring, combined with the plastic laminate, insures that the downward forces applied to thick portion 140 control the overall magnitude of the polishing pad deflection under the wear ring while the inner diameter of the wear ring remains intact to control the inner diameter pad recovery point.

Figure 5:
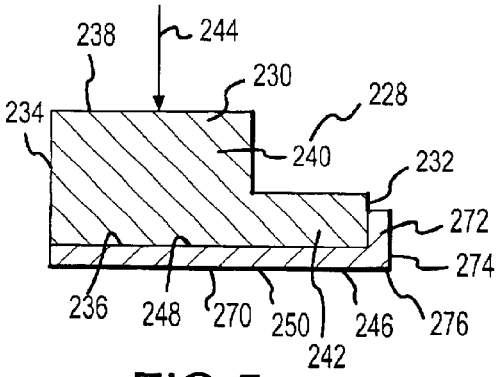
FIG. 5 illustrates, in cross section, a portion of a wear ring in accordance with a further embodiment of the invention.

FIG. 5 illustrates, in cross section, a further embodiment of a wear ring 228 in accordance with a preferred embodiment of the invention. Wear ring 228 includes a toroidal shaped component 230 formed of a high stiffness material such as stainless steel having an inner cylindrical surface 232 and an outer cylindrical surface 234. Lower surface 236 of component 230 is substantially planar. Upper surface 238 is configured to provide a thick portion 240 of component 230 adjacent the outer cylindrical surface and a relatively thinner portion 242 of component 230 adjacent the inner cylindrical surface. The high stiffness material from which component 230 is fabricated insures that downward forces applied to thick portion 240 as indicated schematically by arrow 244 are conveyed to thinner portion 242 without significantly warping or otherwise deforming the thinner portion. In accordance with this embodiment of the invention, wear ring 228 also includes a plastic laminate 246 which has a portion 270 that is attached to lower surface 236 of component 230 and a portion 272 that is attached to the inner cylindrical surface 232. The plastic laminate is toroidal shaped and has an upper surface portion 248 and a lower surface portion 250 each of which are substantially planar. The outer surface 274 of plastic laminate 246 preferably forms a right angle at point 276, i.e., at the ID comer formed by the intersection of portion 270 and portion 272. Point 276 determines the inner diameter pad recovery point. The plastic laminate is preferably formed from any of the materials described above and may be attached to component 230 with any of the adhesives described above. Also, portions 270 and 272 preferably are formed of one integral piece of plastic with at least portion 270 having the same thickness as described above. Portion 272 aids in protecting the inner cylindrical surface of component 230 from chemical attack by components of the slurry used in the CMP operation as well as from mechanical abrasion from contact with the wafer being polished. Portion 272 also covers the joint between laminate 246 and component 230, protecting the adhesive from chemical attack and thus avoiding delamination of laminate 246 from component 230.

Figure 6:
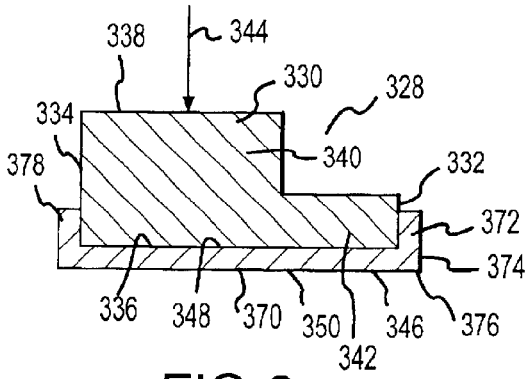
FIG. 6 illustrates, in cross section, a portion of a wear ring in accordance with yet a further embodiment of the invention.

FIG. 6 illustrates, in cross section, a further embodiment of a wear ring 328 in accordance with a further preferred embodiment of the invention. Wear ring 328 includes a toroidal shaped component 330 formed of a high stiffness material such as stainless steel having an inner cylindrical surface 332 and an outer cylindrical surface 334. Lower surface 336 of component 330 is substantially planar. Upper surface 338 is configured to provide a thick portion 340 of component 330 adjacent the outer cylindrical surface and a relatively thinner portion 342 of component 330 adjacent the inner cylindrical surface. The high stiffness material from which component 330 is fabricated insures that downward forces applied to thick portion 340 as indicated schematically by arrow 344 are conveyed to thinner portion 342 without significantly warping or otherwise deforming the thinner portion. In accordance with this embodiment of the invention, wear ring 328 also includes a plastic laminate 346 which has a portion 370 that is attached to lower surface 336 of component 330, a portion 372 that is attached to the inner cylindrical surface 332, and a portion 378 that is attached to the outer cylindrical surface 334. The plastic laminate is toroidal shaped and has an upper surface portion 348 and a lower surface portion 350 each of which are substantially planar. The outer surface 374 of plastic laminate 346 preferably forms a right angle at point 376, i.e., at the ID comer formed by the intersection of portion 370 and portion 372. Point 376 determines the inner diameter pad recovery point. The plastic laminate is preferably formed from any of the materials described above and is attached to component 330 with any of the adhesives described above. Also, portions 370, 372, and 378 preferably are formed of one integral piece of plastic and at least portion 370 has the same thickness as described above. Portion 372 of the plastic laminate aids in protecting the inner cylindrical surface of component 330 from chemical attack by components of the slurry used in the CMP operation as well as from mechanical abrasion from contact with the wafer being polished. Portion 378 of the plastic laminate aids in protecting the outer cylindrical surface of component 330 from chemical attack by components of the slurry used in the CMP operation. Portions 372 and 378 also cover the joint between laminate 346 and component 330, protecting the adhesive from chemical attack and thus avoiding delamination of laminate 346 from component 330.

Thus it is apparent that there has been provided, in accordance with the invention, a wear ring that can be used in a planarization/polishing operation to achieve uniform polishing across the entire surface of a work piece. Although the invention has been described with reference to various illustrative embodiments, it is not intended that the invention be limited to these illustrative embodiments. Those of skill in the art will recognize that may variations and modifications exist that do not depart from the true spirit of the invention. For example, the invention has been described with reference to an apparatus for the CMP processing of a semiconductor wafer. The invention is not to be limited to its application to semiconductor wafers or to a CMP process. Rather the invention is applicable to a broad range of work pieces and to a broad range of planarization or polishing processes performed on such work pieces. Accordingly, it is intended to include within the invention all such variations and modifications as fall within the scope of the appended claims.

What is claimed is:

1. A laminated wear ring for a work piece polishing apparatus, the laminated wear ring comprising:

a toroidal shaped component formed of a high stiffness material and comprising a first substantially planar surface, an interior cylindrical surface and an outer cylindrical surface, the toroidal shaped component further comprising a first thickness adjacent the interior cylindrical surface having a first upper surface and a second thickness greater than the first thickness having a second upper surface adjacent the outer cylindrical surface, a portion of the first and second thicknesses measured in a direction perpendicular to the first substantially planar surface wherein less than a majority of a downward pressure on the laminated wear ring during a polishing process is applied to the first upper surface; and a plastic laminate having first and second substantially parallel, substantially planar surfaces, the first substantially planar surface of the plastic laminate attached to the first substantially planar surface of the toroidal shaped component, the plastic laminate having a thickness measured between the first and second substantially parallel, substantially planar surfaces that is greater than the thickness of a work piece to be polished with the work piece polishing apparatus and less than 1.5 mm.

2. The laminated wear ring of claim 1 wherein the high stiffness material comprises a stainless steel.

3. The laminated wear ring of claim 1 wherein the plastic laminate further comprises an interior wall portion attached to the interior cylindrical surface.

4. The laminated wear ring of claim 3 wherein the plastic laminate further comprises an exterior wall portion attached to the outer cylindrical surface.

5. The laminated wear ring of claim 1 wherein the plastic laminate comprises polyetheretherketone (PEEK).

6. The laminated wear ring of claim 1 wherein the plastic laminate comprises polyethyleneterephthalate (PET) and polytetrafluorocthylene (PTFE).

7. The laminated wear ring of claim 1 wherein the plastic laminate is attached to the first substantially planar surface of the toroidal shaped component using an adhesive.

8. The laminated wear ring of claim 7 wherein the adhesive is selected from a group comprising rubberized epoxy; acrylic adhesive; and cyanoacrylate adhesive.

9. The laminated wear ring of claim 1 wherein grooves are formed in the first substantially planar surface of the toroidal shaped component.

10. A laminated wear ring for a chemical mechanical planarization (CMP) apparatus for polishing a work piece, the laminated wear ring comprising:

a toroidal stainless steel component having a first substantially planar surface, an interior cylindrical surface and an exterior cylindrical surface, the component including a first thickness having a first upper surface adjacent the interior surface and a second thickness greater than the first thickness having a second upper surface adjacent the exterior cylindrical surface wherein less than a majority of a downward pressure applied on the laminated wear ring is applied tom the first upper surface; and a plastic laminate adhesively attached to the first substantially planar surface and a portion of the interior cylindrical surface, the plastic laminate having a thickness less than 1.5 mm.

11. The laminated wear ring of claim 10 wherein the portion of the plastic laminate adhesively attached to the portion of the interior cylindrical surface of the stainless steel component forms and exterior right angle with the first substantially planar surface.

12. The laminated wear ring of claim 11 wherein the plastic laminate further comprises a second component for attachment to the exterior cylindrical surface of the stainless steel component, the second component coupled to and extending from the first substantially planar surface.

13. The laminated wear ring of claim 10 wherein the plastic laminate comprises polyethyleneterephthalate (PET) and polytetrafluroethylene (PTFE).

14. The laminated wear ring of claim 10, wherein the plastic laminate comprises polyetheretherketone (PEEK).

15. The laminated wear ring of claim 10, wherein the plastic laminate is made from a material having a K-factor of not more than $100\times10^{-10}$ $in^3$-min./lb.-ft.-hr.

16. The laminated wear ring of claim 10, wherein the plastic laminate is made from a material having a K-factor of not more than $50\times10^{-10}$ $in^3$-min./lb.-ft.-hr.

17. The laminated wear ring of claim 10, wherein the plastic laminate is made from a material having a coefficient of friction of not more than 0.3.

18. The laminated wear ring of claim 10, wherein the plastic laminate is made from a material having a coefficient of friction of not more than 0.2.

* * * * *